United States Patent [19]

Miura et al.

[11] Patent Number: 4,960,749

[45] Date of Patent: Oct. 2, 1990

[54] SET FOR PRODUCING A COLORED PATTERN

[75] Inventors: Satoshi Miura; Masato Nishimura; Shigeki Itoh; Takashi Asari, all of Yao, Japan

[73] Assignee: Matsumoto Yushi-Seiyaku Co., Ltd., Osaka, Japan

[21] Appl. No.: 212,695

[22] Filed: Jun. 28, 1988

[51] Int. Cl.[5] ..... B41M 5/22

[52] U.S. Cl. ..... 503/213; 503/201; 503/214; 503/226

[58] Field of Search ..... 427/150–152; 503/201, 213, 214, 226

[56] References Cited

U.S. PATENT DOCUMENTS

| | | | |
|---|---|---|---|
| 3,769,045 | 10/1973 | Maierson et al. | 503/214 |
| 3,823,022 | 7/1974 | Thomas | 503/214 |
| 3,957,495 | 5/1976 | Teranishi et al. | 503/208 |
| 4,037,007 | 7/1977 | Wood | 428/199 |

*Primary Examiner*—Pamela R. Schwartz

*Attorney, Agent, or Firm*—Birch, Stewart, Kolasch & Birch

[57] ABSTRACT

The present invention provides a method of making a concavo-convex pattern such as a fingerprint on a given sheet without soiling the pattern with color, and a set for making the pattern.

9 Claims, No Drawings

SET FOR PRODUCING A COLORED PATTERN

BACKGROUND OF THE INVENTION

The present invention relates to a method of making a pattern such as a fingerprint on a sheet and a set therefor.

Hitherto, a fingerprint or a thumbprint (referred to as a fingerprint simply hereinafter) has been taken using vermilion ink or a black ink, but such a manner is disliked because the finger is soiled with the color. Many methods of making a fingerprint without such soil have been studied and developed. For example, Japanese Patent KOKAI No. 93200/1977 discloses a method of making a fingerprint by first placing a developing agent on a finger, secondly placing a colorless coloring reagent on the same finger, and then pressing it on a suitable paper. In such a method, however, the finger may be soiled with color by the reaction of the developing agent and coloring agent on the finger. U.S. Pat No. 3,831,552 proposes use of a magnetic powder, or use of an ultraviolet ink, but both need specific devices, so this method is not suitable for practice.

SUMMARY OF THE INVENTION

An object of the present invention is to provide a method of making a colored pattern such as a fingerprint on a given sheet without a colored soil on the original concavo-convex pattern.

Another object of the present invention is to provide a set for making a colored pattern.

In order to achieve the above objects set consisting of an ink composition containing a colorless electron donative chromophoric compound to be applied on the pattern, and an acidic sheet on which the inked pattern is to be put and pressed; or a set consisting of a discoloring composition containing an acid material and a sheet having a coated layer containing a colorless electron donative chromophoric compound is used.

According to the present invention a clear colored pattern can be easily made on a sheet without any colored soil on an original concavo-convex pattern.

DETAILED DESCRIPTION OF THE INVENTION

The present invention provides:

(1) a method of making a colored pattern which comprises applying an ink composition containing a colorless electron donative chromophoric compound to a concavo-convex pattern, pressing the inked pattern on an acid sheet to develop a colored pattern thereon;

(2) a set for making a colored pattern which comprises an ink composition containing a colorless electron donative chromophoric compound, and an acid sheet;

(3) a method of making a colored pattern which comprises applying a discoloring composition containing an acid material to a concavo-convex pattern, pressing the concavo-convex pattern on a sheet having a coated layer containing a colorless electron donative chromophoric organic material to develop a colored pattern thereon; and (4) a set for making a colored pattern which comprises a discoloring composition containing an acid material, and a sheet having a coated layer containing a colorless electron donative chromophoric compound.

An original pattern to be made on a sheet according to the present invention is a concavo-convex pattern such as a fingerprint, thumbprint, a rubber stamp, a stamp, a carved seal roller (including a roller having a foamed pattern on the surface), a foot shape, a hand shape and the like. According to the present invention, as the original pattern itself is not colored when the ink composition or the discoloring composition is placed thereon, a colored pattern can be made on a sheet without soil on the original pattern such as a digit, hand, foot or cloths.

As a typical concavo-convex pattern of the present invention is a fingerprint or a thumbprint, the present invention is illustrated in case of the pattern being a fingerprint hereinafter, but it should not be construed restrictive to the fingerprint.

The colorless electron donative chromophoric compound of the present invention may be, for example, diaryl phthalides, polyarylcarbinols, leucoauramines, acylauramines, arylauramines, Rhodamine B lactams, indolines, spiropyrans and fluorans.

Concrete examples of these colorless electron donative chromophoric compounds may include Crystal violet lactone, Malachite green lactone, Michler's hydrols, Crystal violet carbinol, Malachite green carbinol, N-(2,3-dichlorophenyl) leucoauramine, N-benzoylauramine, N-acetylauramine, N-phenylauramine, Rhodamine B lactam, 2-(phenyliminoethanedilidene)-3,3-dimethylindoline, N-3,3-trimethylindolinobenzospyropyran, 8'-methoxy-N-3,3-trimethylindolinobenzospiropyran, 3-diethylamino-6-methyl-7-chlorofluoran, 3-diethylamino-7-methoxyfluoran, 3-diethylamino-6-methyl-7-xylydinofluoran, 3-diethylamino-6-benzyloxyfluoran, 1,2-benz-6-diethylaminofluoran and the like.

In the first and second embodiments of the present invention as aforementioned the colorless electron donative chromophoric compound is incorporated into an appropriate medium to prepare an ink composition, which corresponds to a conventional vermilion inkpad or an ink. The ink composition of the present invention may be a liquid or a solid.

The liquid ink composition may be prepared by dispersing or dissolving a colorless electron donative chromophoric compound into a suitable liquid such as water, organic solvent and the like. A solution of the electron donative chromophoric compound in an organic solvent may be emulsified in water. The viscosity of the solution, dispersion, or emulsion may be controlled with a suitable viscosity modifier such as polyalkylene glycol, ethyl cellulose, paraffins and the like to control the ink amount applied on the digit.

Another embodiment of the ink composition is a solid one containing an colorless electron donative chromophoric compound in solidifying materials such as paraffins, waxes, resins and the like. The electron donative chromophoric compound may be incorporated into such solidifying materials directly or in a form of a solution in a suitable organic solvent. The latter is more preferable because the hardness, softening temperature, solubility or concentration of chromophoric compound in the ink, the amount of ink applied on the digit and so on can be easily controlled by the selection of the solvent, amount of solvent, combination effect of the solvent and the solidifying materials, and clearness of colored pattern on an acid sheet.

Waxes should be controlled neutral or weak alkaline to prevent the ink composition itself from coloring before use.

Examples of the waxes include carnauba wax, ouricury wax, montan wax, bleached montan wax, candelilla wax, sugar cane wax, oxidized microwax, rice oil wax, α-olefines, Japan wax, petrolutam, fatty amides (stearyl amide and the like), fatty ketones (stearone, palmitone and the like) and the like.

Preferable solidifying materials for making a fingerprint are such solid materials that an ink composition obtained is softened by the pressure and temperature of a digit when it is placed and pressed on the ink composition, and a small amount of the softened ink is applied to the convex part alone of the digit. Examples of such solidifying materials may include paraffins and resins such as a wax-like polyethylene, polypropylene, polyvinylchlorides containing a plasticizer, and the like. Most preferably these materials have a melting point of, 40°-80° C., but the preferable melting point is dependent on several factors such as the kind of solvent, and amount of the solvent into which the electron donative chromophoric compound is dissolved. As paraffins are neutral and do not develop the colorless electrodonative chromophoric compound, they are most preferable.

The transferability of an ink composition to a digit may be improved by adding a plasticizer into a solidified ink composition. As such a plasticizer, a general one, for instance, DOP, DBP, TCO and the like may be used. The total amount of the solvent and the plasticizer may be less than 65% by weight, preferably less than 30% by weight based on the total amount of the ink composition. If the total amount of the solvent and the plasticizer exceeds 60% by weight, they become liable to bleed on the surface of the solid ink composition.

The content of the colorless electron donative chromophoric compound may be 0.5 to 20% by weight based on the total weight of the ink composition, more preferably 1-12% by weight.

The ink composition of the present invention may contain perfumes, antioxidants and other additives.

The ink composition may be prepared as a tape or a sheet by impregnated into or coated on a tape- or sheet-like substrate such as paper.

The ink composition may be partially printed on a non-acid area of an acid sheet as described hereinafter or a label coated with the ink composition is attached to a part of the acid sheet.

The acid paper according to the first or second embodiment of the present invention may be a sheet wholly or partially impregnated or coated with an acid-containing composition thereon. As an acid sheet an acid paper used in a conventional pressure sensitive copying paper may be applied as it is.

Examples of the acid materials used in the acid sheet may include inorganic solid acids such as silica-alumina, silica-magnesia, bentonite, kaolin, fuller's earth, terra abla, activated clay, montomorillonite, attapulgite, zinc oxide, titanium dioxide, calcium sulfate, barium sulfate, aluminum sulfate, aluminum chloride, lead chloride, tin chloride, silton clay (available from Mizusawa Kagaku K.K.) and the like; organic acids such as a lower fatty acid, e.g. acetic acid, propynoic acid, lactic acid; phenolic acids, e.g. tert-butyl phenol, nonylphenol, dodecylphenol, α-naphthol, β-naphthol, hydroquinone monomethyl ether, p-chlorophenol, o-bromophenol, o-phenylphenol, p-phenylphenol,, methyl p-oxybenzoate, 3-isopropylcatechol, p-tert-butylcatechol, bisphenol A, 1,2-dioxynaphthalene, 2,3-dioxynaphthalene, chlorocathecol, bromocathecol, 2,4-dihydroxybenzophenone, phenolphthalein, methyl gallate, ethyl gallate, propyl gallate, butyl gallate, hexyl gallate, octyl gallate, dodecyl gallate, cetyl gallate, stearyl gallate, tannic acid, p-phenylphenol/formaldehyde condensation products, p-tert-butylphenol/formaldehyde condensation products, p-cumylphenol/formaldehyde condensation products, p-octylphenol/formaldehyde condensation products, p-cresol/formaldehyde condensation products, phenol/acetylene polymer, salicylic acid/formaldehyde condensation products, salicylic acid, protocatechuic acid, piperonylic acid, resorcylic acid, gentisic acid, orsellinic acid, oxyphthalic acid, dioxyphthalic acid, esters thereof and salts such as zinc salts, aluminum salts, magnesium salts, zirconium salts, barium salts or others thereof; salts of fatty carboxylic acids or aromatic carboxylic acids, for instance, zinc maleate, metal salts of maleic acid/rosin resins, metal salts of styrene/-maleic acid anhydride copolymer, zinc benzoate and the like. Esters or metal salts of aromatic compound having phenolic hydroxyl group such as zinc salicylate are most preferable because of their immediate coloration after putting a fingerprint on the acid sheet.

These acid materials are applied to a sheet together with a suitable binder. Examples of the binder styrene/-butadiene emulsion, natural rubber latex, acrylic resin emulsion, polyvinylacetate emulsion, carboxymethyl cellulose, hydroxyethyl cellulose, methyl cellulose, polyvinyl alcohol and the like.

The acid materials may be contained in the amount of from about 2 to 50% by weight, preferably about 10 to 30% by weight based on the acid composition. The acid composition may contain suitable additives such as viscosity modifiers, extender pigment (e.g. barium sulfate, calcium sulfate, antimony oxide etc.), white pigment (e.g. titanium oxide, zinc oxide etc.), coloring pigment for emphasizing a colored fingerprint, an ultraviolet absorber and the like.

The acid composition may be applied on a sheet by, for example, coating, dipping, spraying, printing and the like. It may be spot-printed on a given area.

According to the third or fourth embodiment of the present invention, a discoloring composition is made from acid materials and a suitable medium, and a sheet on which a fingerprint is made is made from a colorless electron donative chromophoric compound and a suitable binder. A digit is placed on the discoloring composition, and then put on and placed onto the sheet to give a colored fingerprint on the sheet.

In these embodiments the same colorless electron donative chromophoric compound as the above can be used, which may be incorporated into a printing ink suitable for coating or printing. The printing ink contains binders such as a wax or a resinous material in order to adhere the colorless electron donative chromophoric compound on the sheet. The electron donative chromophoric compound may be dissolved in a suitable solvent and mixed with the waxes or binders. As the wax and resinous material used as a binder a material which does not develop the colorless electron donative,,chromophoric compound should be used. As such a material there are exemplified waxes described in the explanation of the ink composition, i.e. carnauba wax, ouricury wax, nontan wax, bleached montan wax, candelilla wax, sugar cane wax, oxidized microwax, rice oil wax, α-olefines, Japan wax, petrolutam, fatty amide, fatty ketones and the like; binders such as styrene/-butadiene emulsion, natural rubber latex polyvinylacetate emulsion, carboxymethyl cellulose, hydroxyethyl cellulose, methyl cellulose, polyvinyl alcohol and the like. Such a binder should be controlled neutral or weakly acid. The printing ink may contain additives as usually used in an ink for a non-carbon paper such as extender pigments, white pigment and so on. The printing ink may printed or coated on the sheet according to a conventional manner such as thermogravure printing, thermo-flexographic printing and the like.

In these third and fourth embodiments the acid materials are formed to a suitable shape to be applied on a digit. In this specification such a formed material is referred to a discoloring composition.

The discoloring composition may be formed a liquid, a pad, a wax, a paste, a sheet and the like as referred to the explanation of the ink composition containing the electron donative chromophoric compound. Basically, the discoloring composition is softened by the pressure and temperature of a digit, if it is used as a waxy composition, and contains the acid in the amount sufficient to develop the electron donative chromophoric compound on the sheet. The components for preparing the discoloring composition are preferably selected from materials resistible to the acid. As such materials carbon waxes and paraffins are exemplified.

In case that the acid materials are water-soluble, an aqueous solution of the acid materials may be absorbed in a water-absorbable polymer such as graft polymer of cellulose, a copolymer of a hydrophilic aromatic polyester and an acrylic acid, which can be prepared according to Japanese Patent Application KOKAI No.109241/81, and the like.

The amount of the acid materials may be generally 2 to 50 parts by weight, preferably 3 to 25 parts by weight, which of course depends on the kind of acid materials. The acid materials may be a mixture.

The method of making a colored pattern on the sheet may be used for making a pattern of a hand shape, a foot shape or another concavo-convex pattern.

The present invention will be illustrated according to the following examples.

EXAMPLE 1

Crystal violet lactone (colorless) 2 parts by weight was dissolved in diisopropylnaphthalene 48 parts by weight, and the solution obtained was homogeneously mixed with 155° F. paraffin (mp.68° C.) 50 parts by weight melted at 70° C. The mixture was poured into a plastic tray ($50\times70\times10$ mm$^3$), and then cooled to give a wax-like colorless ink composition.

On the other hand zinc salicylate 15 parts by weight, carnauba wax 50 parts by weight and paraffin wax (mp. 68° C.) were homogeneously blended at about 90° C. by a three-role-blender. The obtained mixture was coated on paper at a ratio of 10 g/m$^2$ to give an acid sheet.

A finger was put on the wax-like colorless ink composition, and then placed on and then pressed onto the acid sheet. A clear blue fingerprint was taken on the sheet, but the finger was not colored.

EXAMPLE 2

Malachite green lactone (colorless) 2 parts by weight was dissolved in diisopropylnaphthalene 95 parts by weight. The viscosity of the obtained solution was controlled with polynorbonene 3 parts by weight to give a liquid colorless ink composition. The ink composition was absorbed in an absorbent cotton pad contained in a gauze sack in such a manner that the liquid ink composition slightly seeped out the pad.

On the obtained inkpad a finger was put, and then pressed onto an acid sheet of a commercially available noncarbon copying paper. A clear green fingerprint was obtained on the sheet without soil on the finger.

EXAMPLE 3

Crystal violet lactone (colorless) 10 parts by weight, titanium oxide 25 parts by weight, benzotriazol type ultraviolet absorbent 3.0 parts by weight were homogeneously mixed, and then mixed with aqueous solution of polyvinyl alcohol (25 wt. %) 50 parts by weight. The obtained mixture was coated on paper at a ratio of 5 g/m$^2$ to give a colorless sheet.

On the other hand zinc salicylate 10 parts by weight, caster wax 60 parts by weight, paraffin wax 10 parts by weight and DOP 20 parts by weight were homogeneously mixed at 90° C. The mixture was poured into a plastic tray ($50\times70\times10$ mm$^3$) and cooled to give a wax-like discoloring composition.

A finger was put on the discoloring composition, and then pressed onto the obtained sheet. A clear blue fingerprint was taken on the sheet, but the finger was not soiled with color.

EXAMPLE 4

Leuco dye black 4.4 parts by weight was dissolved in diisopropylnaphthalene 50.6 parts by weight, and then homogeneously mixed with polyethylene wax (mp. 118 ° C.) 45 parts by weight melted at 130° C. The resultant was poured into a stainless tray ($50\times70\times10$ mm$^3$), and cooled to give a wax-like colorless ink composition.

A finger was put on the ink composition and then pressed onto the acid sheet obtained in Example 1. A clear black fingerprint was made on the sheet, and the finger was not soiled with color.

What is claimed is:

1. A set for producing a colored pattern, which comprises:

an ink composition comprising a colorless electron donative chromophoric compound, a solvent and/or plasticizer, and a solidifying material, said ink composition capable of being softened by the pressure and temperature of a digit, and an acid sheet.

2. The set of claim 1, in which said acid sheet is paper partially or wholly coated with an acid material comprising a polymer or wax having one or more phenolic group.

3. The set of claim 1, wherein the ink composition comprises, based on the total weight of said composition, 0.5 to 20% by weight of the colorless electron donative chromophoric compound, less than 60% by weight of the solvent and/or plasticizer.

4. The set of claim 1, wherein the solvent and/or plasticizer of said ink composition is comprised mainly of an alkylnaphthalene solvent.

5. The set of claim 1, wherein the solvent and/or plasticizer of said ink composition is comprised mainly of diisopropylnaphthalene solvent.

6. The set of claim 1, wherein the solidifying material of said ink composition is a paraffin or a resin.

7. The set of claim 1, wherein the solidifying material of said ink composition is a resin selected from the group consisting of polyethylene, polypropylene and polyvinylchloride.

8. The set of claim 1, wherein the solidifying material of said ink composition is a polyethylene.

9. The set of claim 1, wherein the colorless electron donative chromophoric compound of said ink composition is selected from the group consisting of a diaryl phthalide, a polyarylcarbinol, a leucoauramine, an acylauramine, an arylauramine, a Rhodamine B lactam, an indoline, a spiropyran and a fluoran.

* * * * *